US009850855B2

(12) United States Patent
Matsunaga et al.

(10) Patent No.: US 9,850,855 B2
(45) Date of Patent: Dec. 26, 2017

(54) FUEL EVAPORATIVE GAS EMISSION CONTROL APPARATUS

(71) Applicant: MITSUBISHI JIDOSHA KOGYO KABUSHIKI KAISHA, Tokyo (JP)

(72) Inventors: Hideo Matsunaga, Okazaki (JP); Katsuhiro Furuta, Okazaki (JP); Kyosuke Uematsu, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 185 days.

(21) Appl. No.: 14/976,902

(22) Filed: Dec. 21, 2015

(65) Prior Publication Data

US 2016/0177883 A1 Jun. 23, 2016

(30) Foreign Application Priority Data

Dec. 22, 2014 (JP) ..... 2014-259075

(51) Int. Cl.
*F02M 1/00* (2006.01)
*F02M 25/08* (2006.01)

(52) U.S. Cl.
CPC .... *F02M 25/0818* (2013.01); *F02M 25/0836* (2013.01)

(58) Field of Classification Search
CPC ..... F02M 37/0023; F02M 37/0052; F02M 25/0836; F02M 55/007; F02M 33/02; F02D 41/003; F02D 41/0032; F02D 41/0045
USPC ..... 123/510, 516–521
See application file for complete search history.

(56) References Cited

U.S. PATENT DOCUMENTS 6,148,803 A * 11/2000 Majima ..... F02M 25/0809 123/520
2012/0047999 A1* 3/2012 Itoh ..... F02M 25/0818 73/40

FOREIGN PATENT DOCUMENTS

JP 4107053 B2 6/2008

* cited by examiner

*Primary Examiner* — John Kwon
(74) *Attorney, Agent, or Firm* — Birch, Stewart, Kolasch & Birch, LLP

(57) ABSTRACT

When a leak test for a purge pipe and a vapor pipe as targets is executed, a sealing valve that is being closed is opened while an open state of a bypass valve is kept prior to the execution of the leak test, fuel evaporative gas in a fuel tank is caused to flow out to a canister side to reduce a tank internal pressure Ptan to a valve opening guarantee determination value P0, and after the bypass valve is closed subsequently, the leak test is started.

20 Claims, 6 Drawing Sheets

FUEL EVAPORATIVE GAS EMISSION CONTROL APPARATUS

BACKGROUND OF THE INVENTION

Field of the Invention

The present invention relates to a fuel evaporative gas emission control apparatus, and particularly to an abnormality detection technique of the fuel evaporative gas emission control apparatus.

Description of the Related Art

Conventionally, in order to prevent release of fuel evaporative gas that is evaporated in a fuel tank into the atmosphere, there has been proposed a fuel evaporative gas emission control apparatus that is configured by a canister that is interposed in a communication path that provides communication between a fuel tank and an intake passage of an internal combustion engine, a sealing valve that provides communication or blockage between the fuel tank and the canister, and a purge valve that provides communication and blockage of the communication path between the intake passage and the canister (refer to Japanese Patent No. 4107053, for example). The fuel evaporative gas emission control apparatus causes the fuel evaporative gas in the fuel tank to flow out to the canister by opening the sealing valve and closing the purge valve at a time of refueling, and causes the fuel evaporative gas to adsorb to the activated carbon that is placed in the canister. Subsequently, the fuel evaporative gas emission control apparatus opens the purge valve to discharge the fuel evaporative gas, which is caused to adsorb to the activated carbon in the canister, to the intake passage of the internal combustion engine and treats the fuel evaporative gas, at an operation time of the internal combustion engine.

Incidentally, in the fuel evaporative gas emission control apparatuses including canisters as above, there is also a fuel evaporative gas emission control apparatus that further includes a canister opening and closing valve that opens and closes the communication path and the canister. The canister opening and closing valve is used in leak monitoring of the fuel tank, the canister, the communication path and the like that configure the fuel evaporative gas emission control apparatus, for example, measures the state of change in the internal pressure of the communication path by closing the canister opening and closing valve, thereafter measures the state of change in the canister internal pressure by opening the canister opening and closing valve, and from the measurement results, determines presence or absence of leak in the communication path.

However, the leak monitoring described above cannot be carried out normally in some cases when the pressure in the fuel tank is high. For example, when the temperature of the fuel tank increases due to the high-temperature outside air during soak in which a vehicle is parked, the tank internal pressure increases and acts on the canister opening and closing valve which is being closed. Since in the state where the high tank internal pressure acts like this, a valve opening delay occurs to the canister opening and closing valve, and the canister opening and closing valve cannot be opened at a proper timing, there arises the problem that leak monitoring cannot be carried out normally.

SUMMARY OF THE INVENTION

The present invention is made to solve the problem as above, and an object of the present invention is to provide a fuel evaporative gas emission control apparatus that can prevent a valve opening delay of a canister opening and closing valve due to high tank internal pressure, and can carry out leak monitoring by opening the canister opening and closing valve at a proper timing.

In order to achieve the above described object, a fuel evaporative gas emission control apparatus of the present invention includes a communication path that provides communication between an intake passage of an internal combustion engine and a fuel tank, a canister that is connected to the communication path and adsorbs fuel evaporative gas in the communication path, a canister opening and closing valve that opens and closes communication between the communication path and the canister, a purge valve that opens and closes the communication path between the intake passage and the canister, a sealing valve that opens and closes communication between the fuel tank and the communication path, a leak test execution unit that executes a leak test by opening the sealing valve and closing the canister opening and closing valve, and thereafter opening the canister opening and closing valve, in a state where the purge valve is closed, and a pressure regulation control unit that prior to the leak test by the leak test execution unit, reduces an internal pressure of the fuel tank to a valve opening guarantee determination value that is set in advance by opening the sealing valve which is being closed while keeping the canister opening and closing valve in an open state, and thereafter closes the canister opening and closing valve.

According to the fuel evaporative gas emission control apparatus which is configured as above, a valve opening delay of the canister opening and closing valve due to a high internal pressure of the tank can be prevented, and leak monitoring can be carried out by opening the canister opening and closing valve at a suitable timing.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

Hereinafter, an embodiment of the present invention will be described based on the drawings.

Figure 1:
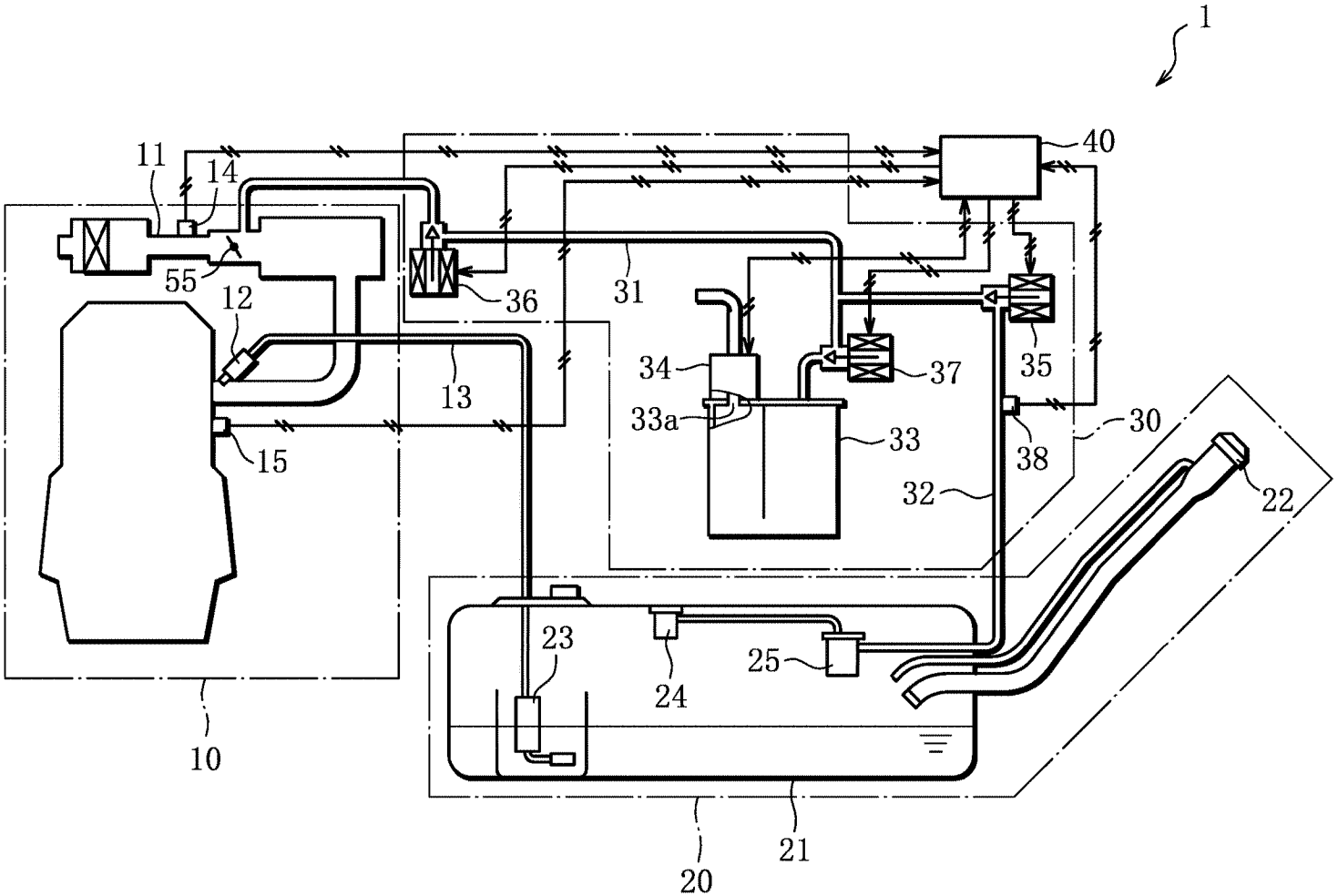
FIG. 1 is a schematic configuration diagram of a fuel evaporative gas emission control apparatus according to one embodiment of the present invention.
Figure 2:
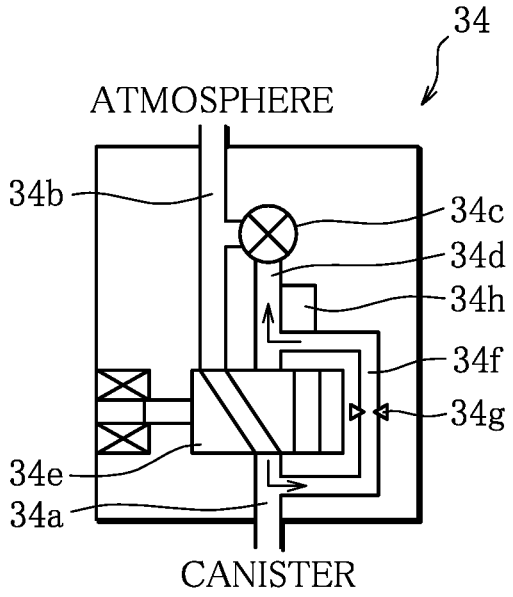
FIG. 2 is a diagram showing an operation of internal components at a non-operation time of a changeover valve of an evaporative leak check module.
Figure 3:
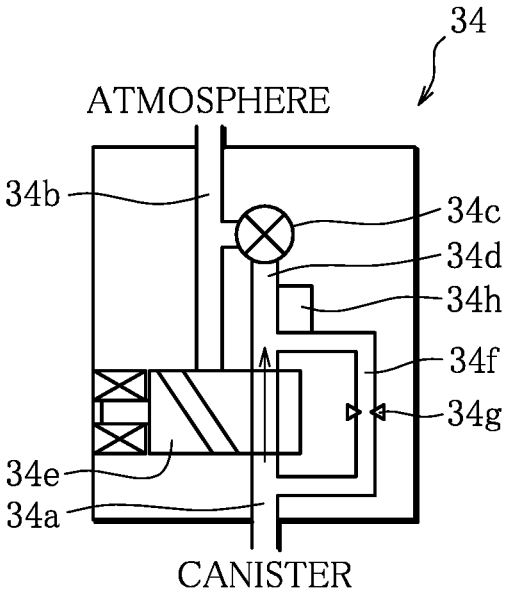
FIG. 3 is a diagram showing an operation of the internal components at an operation time of the changeover valve of the evaporative leak check module.

FIG. 1 is a schematic configuration diagram of a fuel evaporative gas emission control apparatus 1 according to one embodiment of the present invention. Further, FIG. 2 is a diagram showing an operation of internal components at a non-operation time of a changeover valve 34*e* of an evaporative leak check module 34, and FIG. 3 is a diagram showing an operation of the internal components at an operation time of the changeover valve 34*e* of the evaporative leak check module 34. Arrows in FIGS. 2 and 3 show directions of air flows in a case where a negative pressure pump 34*c* in the evaporative leak check module 34 is operated in states of the drawings. The changeover valve 34 is in an open state at the non-operation time in FIG. 2, and is in a closed state at the operation time in FIG. 3. Hereinafter, a configuration of the fuel evaporative gas emission control apparatus will be described.

The fuel evaporative gas emission control apparatus 1 according to the present embodiment is used in a hybrid vehicle or a plug-in hybrid vehicle that includes a drive motor not illustrated and an engine 10 (an internal combustion engine), and travels by using either one or both of the drive motor and the engine 10.

As shown in FIG. 1, the fuel evaporative gas emission control apparatus 1 is mainly configured by the engine 10 which is loaded on a vehicle, a fuel storage section 20 that stores fuel, a fuel evaporative gas treatment section 30 that treats evaporative gas of the fuel which is evaporated in the fuel storage section 20, and an electronic control unit (hereinafter, referred to as ECU) 40 that is a control device for performing overall control of the vehicle.

The engine 10 is a multi point injection (Multi Point Injection: MPI) type gasoline engine. The engine 10 is provided with an intake passage 11 that takes air into a combustion chamber of the engine 10. Further, a fuel injection valve 12 that injects fuel into an intake port of the engine 10 is provided downstream of the intake passage 11. A fuel pipe 13 is connected to the fuel injection valve 12, and is supplied with fuel from a fuel tank 21 that stores the fuel.

In the intake passage 11 of the engine 10, an intake air temperature sensor 14 that detects a temperature of the air which is taken in is placed. Further, in the engine 10, a water temperature sensor 15 that detects a temperature of cooling water that cools the engine 10 is placed.

The fuel storage section 20 is configured by the fuel tank 21, a fuel supply port 22 that is a fuel filling port to the fuel tank 21, a fuel pump 23 that supplies fuel to the fuel injection valve 12 via the fuel pipe 13 from the fuel tank 21, a fuel cutoff valve 24 that prevents outflow of the fuel from the fuel tank 21 to a fuel evaporative gas treatment section 30, and a leveling valve 25 that controls a liquid level in the fuel tank 21 at a time of refueling. Further, the fuel evaporative gas that is generated in the fuel tank 21 is discharged to the fuel evaporative gas treatment section 30 via the leveling valve 25 from the fuel cutoff valve 24.

The fuel evaporative gas treatment section 30 is configured by a purge pipe 31 (a communication path), a vapor pipe 32 (a communication path), a canister 33, the evaporative leak check module 34, a sealing valve 35, a purge valve 36 (a purge valve), a bypass valve 37 (a canister opening and closing valve) and a pressure sensor 38.

The purge pipe 31 is provided to provides communication between the intake passage 11 of the engine 10 and the canister 33.

The vapor pipe 32 is provided to provide communication between the leveling valve 25 of the fuel tank 21 and the purge pipe 31. That is, the vapor pipe 32 is provided to provide communication between the fuel tank 21 and the purge pipe 31.

The canister 33 has an activated carbon therein. Further, the purge pipe 31 is connected to the canister 33 so that the fuel evaporative gas generated in the fuel tank 21 or the fuel evaporative gas that is adsorbed by the activated carbon can flow through the purge pipe 31. Further, the canister 33 is provided with an atmosphere hole 33*a* that takes in the outside air when the fuel evaporative gas that is adsorbed by the activated carbon is released to the intake passage 11 of the engine 10.

As shown in FIGS. 2 and 3, the evaporative leak check module 34 is provided with a canister side passage 34*a* that leads to an atmosphere hole 33*a* of the canister 33, and an atmosphere side passage 34*b* that leads to the atmosphere. A pump passage 34*d* that includes the negative pressure pump 34*c* communicates with the atmosphere side passage 34*b*. Further, the evaporative leak check module 34 is provided with the changeover valve 34*e* and a bypass passage 34*f*. The changeover valve 34*e* includes an electromagnetic solenoid, and is driven by the electromagnetic solenoid. When the electromagnetic solenoid is in a nonenergized state (OFF), the changeover valve 34*e* provides communication between the canister side passage 34*a* and the atmosphere side passage 34*b* (corresponding to an open state of the changeover valve 34*e*). Further, when the electromagnetic solenoid is supplied with a drive signal from outside and is in an energized state (ON), the changeover valve 34*e* provides communication between the canister side passage 34*a* and the pump passage 34*d* as shown in FIG. 3 (corresponding to a closed state of the changeover valve 34*e*).

The bypass passage 34*f* is a passage that always causes the canister side passage 34*a* and the pump passage 34*d* to continue to each other, and is provided with a reference orifice 34*g* with a small diameter (for example, a diameter of 0.45 mm). Further, a pressure sensor 34*h* that detects a canister internal pressure Pcan is provided between the negative pressure pump 34*c* of the pump passage 34*d* and the reference orifice 34*g* of the bypass passage 34*f*. A detection target of the pressure sensor 34*h* is switched in accordance with opening and closing of the changeover valve 34*e*, and at an opening time of the changeover valve 34*e*, a pressure in the bypass passage 34*f* downstream of the reference orifice 34*g* is detected as the canister internal pressure Pcan, and at a closing time of the changeover valve 34*e*, a pressure inside the canister 33 is detected as the canister internal pressure Pcan via the canister side passage 34*a*.

The sealing valve 35 is interposed in the vapor pipe 32 between the fuel tank 21 and the purge pipe 31. The sealing valve 35 includes an electromagnetic solenoid, and is driven by the electromagnetic solenoid. The sealing valve 35 is an electromagnetic valve of a normally closed type that is brought into a closed state in a state where the electromagnetic solenoid is nonenergized (OFF), and is brought into an open state when the electromagnetic solenoid is supplied with a drive signal from outside and is brought into an energized state (ON). The sealing valve 35 closes the vapor pipe 32 when the electromagnetic solenoid is in a nonenergized state (OFF) and the sealing valve 35 is in a closed state, and opens the vapor pipe 32 when the electromagnetic solenoid is supplied with a drive signal from outside and is in an energized state (ON) and the sealing valve is in an open state. That is, the sealing valve 35 closes the fuel tank 21 into a sealed state when the sealing valve 35 is in the closed state, disables outflow of the fuel evaporative gas which is generated in the fuel tank 21 into the canister 33 or the intake passage 11 of the engine 10, and enables outflow of the fuel evaporative gas into the canister 33 or the intake passage 11 of the engine 10 when the sealing valve 35 is in an open state.

The purge valve 36 is interposed in the purge pipe 31 between the intake passage 11 and a connection portion of the purge pipe 31 to the vapor pipe 32. The purge valve 36 includes an electromagnetic solenoid, and is driven by the electromagnetic solenoid. The purge valve 36 is a normally closed type electromagnetic valve that is brought into a closed state when the electromagnetic solenoid is in a nonenergized state (OFF), and is brought into an open state when the electromagnetic solenoid is supplied with a drive signal from outside and is in an energized state (ON). The purge valve 36 closes the purge pipe 31 when the electromagnetic solenoid is in a nonenergized state (OFF) and in a closed state, and opens the purge pipe 31 when the electromagnetic solenoid is supplied with a drive signal from outside and is in an energized state (ON) and the purge valve 36 is in an open state. That is, the purge valve 36 disables outflow of the fuel evaporative gas to the intake passage 11 of the engine 10 from the canister 33 or the fuel tank 21 when the purge valve 36 is in a closed state, and enables outflow of the fuel evaporative gas into the intake passage 11 of the engine 10 from the canister 33 or the fuel tank 21 when the purge valve 36 is in an open state.

The bypass valve 37 is interposed in the purge pipe 31 between the connection portion of the vapor pipe 32 to the purge pipe 31 and the canister 33. The bypass valve 37 includes an electromagnetic solenoid, and is driven by the electromagnetic solenoid. The bypass valve 37 is a normally open type electromagnetic valve that is brought into an open state when the electromagnetic solenoid is in a nonenergized state (OFF), and is brought into a closed state when the electromagnetic solenoid is supplied with a drive signal from outside and is brought into an energized state (ON). The bypass valve 37 opens the canister 33 to the purge pipe 31 when the electromagnetic solenoid is in the nonenergized state (OFF) and the bypass valve 37 is in an open state, and closes the canister 33 when the electromagnetic solenoid is supplied with a drive signal from outside and is in an energized state (ON) and the bypass valve 37 is in the closed state. That is, the bypass valve 37 seals the canister 33 when the bypass valve 37 is in a closed state, and disables inflow of the fuel evaporative gas to the canister 33 or outflow of the fuel evaporative gas from the canister 33. When the bypass valve 37 is in the open state, the bypass valve 37 enables inflow of the fuel evaporative gas to the canister 33 or outflow of the fuel evaporative gas from the canister 33.

The pressure sensor 38 is placed in the vapor pipe 32 between the fuel tank 21 and the sealing valve 35. The pressure sensor 38 detects the tank internal pressure Ptan which is the internal pressure of the fuel tank 21. The pressure sensor 38 can detect the internal pressure of only the fuel tank 21 only when the sealing valve 35 is in the closed state and the fuel tank 21 is sealed.

The ECU 40 is a control device for performing overall control of the vehicle, and is configured by including an input and output device, a storage device (a ROM, a RAM, a nonvolatile RAM and the like), a central processing unit (CPU), a timer and the like.

To an input side of the ECU 40, the intake temperature sensor 14, the water temperature sensor 15, the pressure sensor 34*h* and the pressure sensor 38 that are described above are connected, and detection information from these sensors is inputted.

Meanwhile, to an output side of the ECU 40, the fuel injection valve 12, the fuel pump 23, the negative pressure pump 34*c*, the changeover valve 34*e*, the sealing valve 35, the purge valve 36 and the bypass valve 37 which are described above are connected.

The ECU 40 controls an operation of the negative pressure pump 34*c*, and opening and closing of the changeover valve 34*e*, the sealing valve 35, the purge valve 36 and the bypass valve 37, and enables adsorption of the fuel evaporative gas which is generated in the fuel tank 21 to the canister 33, and purge treatment (canister purge, tank purge) that discharges the fuel evaporative gas that adsorbs to the canister 33 at the operation time of the engine 10, and the fuel evaporative gas which is generated in the fuel tank 21 to the intake passage 11 of the engine 10.

The canister purge is performed for a predetermined time period directly after engine start, for example.

The ECU 40 opens the purge valve 36 and the bypass valve 37 during an engine operation, in the canister purge. At this time, the sealing valve 35 is in a closed state, and the changeover valve 34*e* is in an open state. Thereby, the purge pipe 31 and the canister 33 communicate with the intake passage 11 of the engine 10, and therefore, atmosphere passes through the canister 33 and the purge pipe 31 to flow into the intake passage 11 which has a negative pressure by the operation of the engine 10 from an outside air inlet port of the canister 33. Accordingly, the fuel evaporative gas which is adsorbed by the canister 33 is discharged to the intake passage 11 and is treated.

Tank purge is performed when the pressure in the fuel tank 21 becomes a high pressure of a predetermined pressure P1 or, more until the pressure in the fuel tank 21 is reduced, during an operation of the engine 10. The ECU 40 opens the sealing valve 35 and the purge valve 36, and closes the bypass valve 37, as the tank purge. Thereby, the fuel tank 21 communicates with the intake passage 11 of the engine 10 via the purge pipe 31 and the vapor pipe 32, and therefore, the fuel evaporative gas passes through the vapor pipe 32 and the purge pipe 31 from the fuel tank 21 and flows into the intake passage 11 which has a negative pressure by the operation of the engine 10. Accordingly, the fuel evaporative gas in the fuel tank 21 is discharged to the intake passage 11 and is treated, and the pressure in the fuel tank 21 is reduced. The tank purge is performed with higher priority than the canister purge. Accordingly, when the pressure in the fuel tank 21 is the predetermined pressure P1 or more immediately after startup of the engine, the canister purge is performed after the tank purge is performed.

Further, the ECU 40 executes leak monitoring that determines presence or absence of leak of the fuel tank 21, the canister 33, the purge pipe 31 and the vapor pipe 32 (sticking of the sealing valve 35, the changeover valve 34*c*, the bypass valve 37 and the purge valve 36 in addition) while the ignition switch is turned off (a leak test execution unit).

Figure 4:
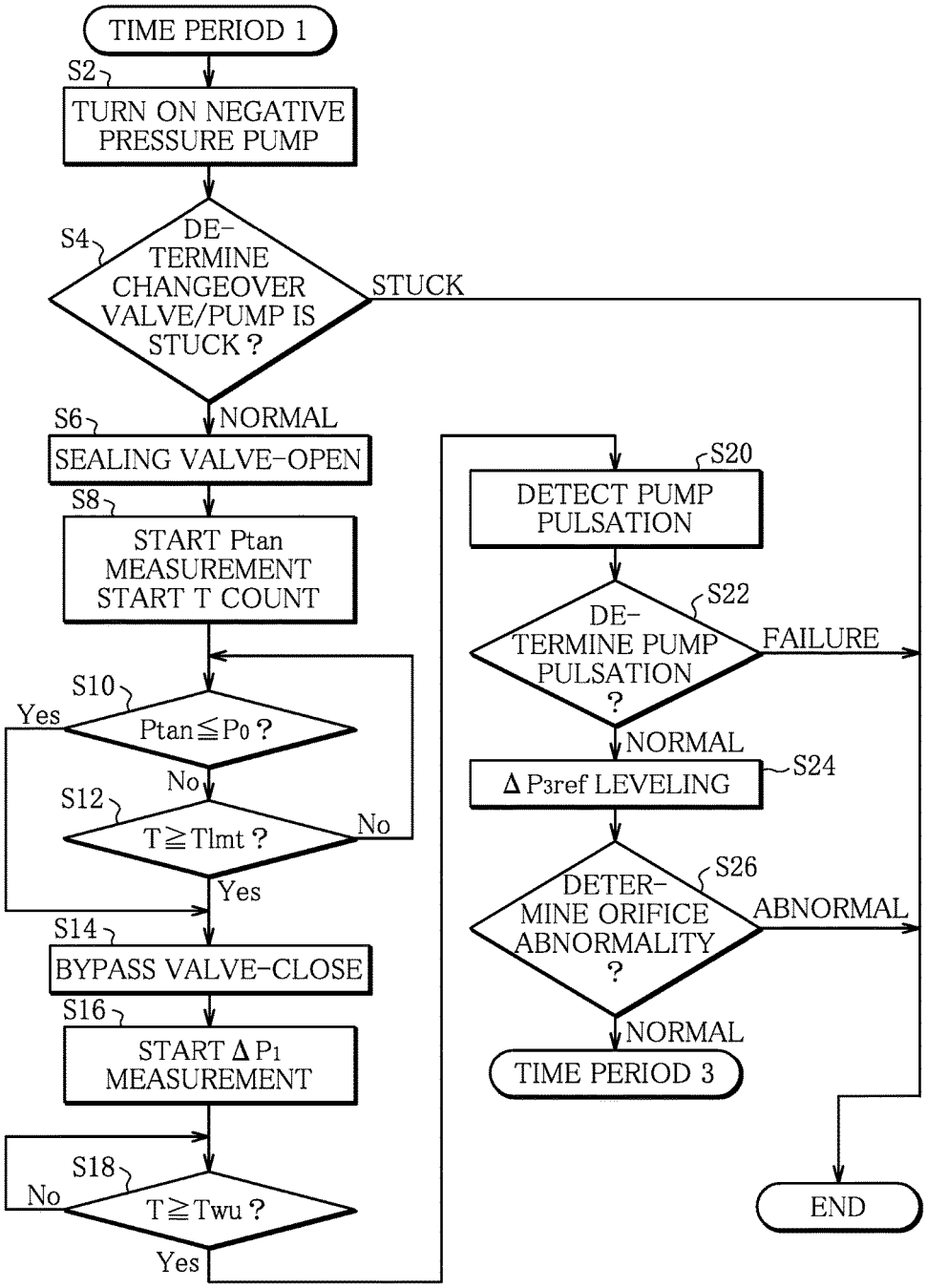
FIG. 4 is a flowchart showing a control procedure of leak monitoring that is executed by an ECU of the present embodiment.
Figure 5:
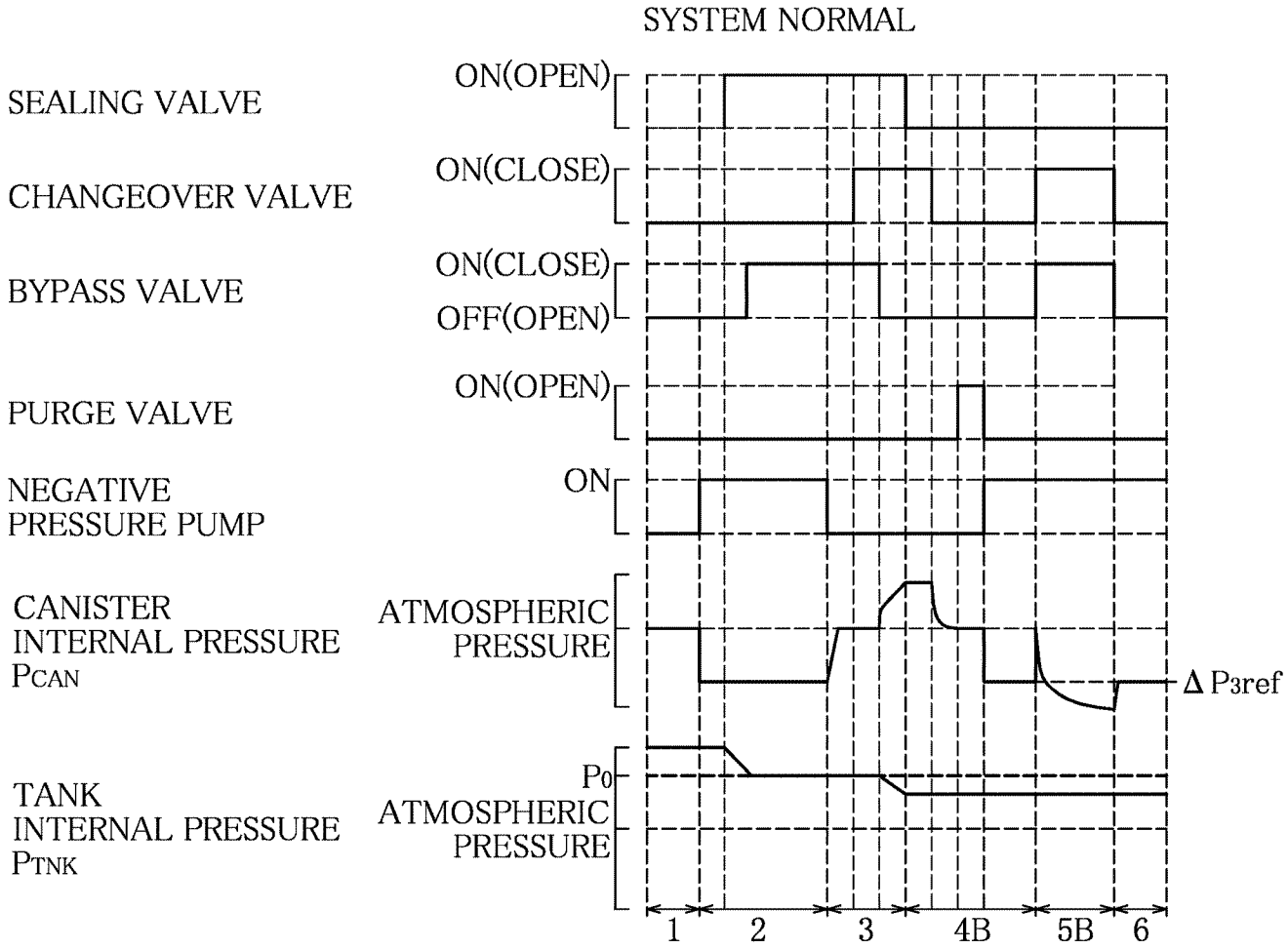
FIG. 5 is a time chart showing a control situation of leak monitoring in a case where an entire system is normal.
Figure 6:
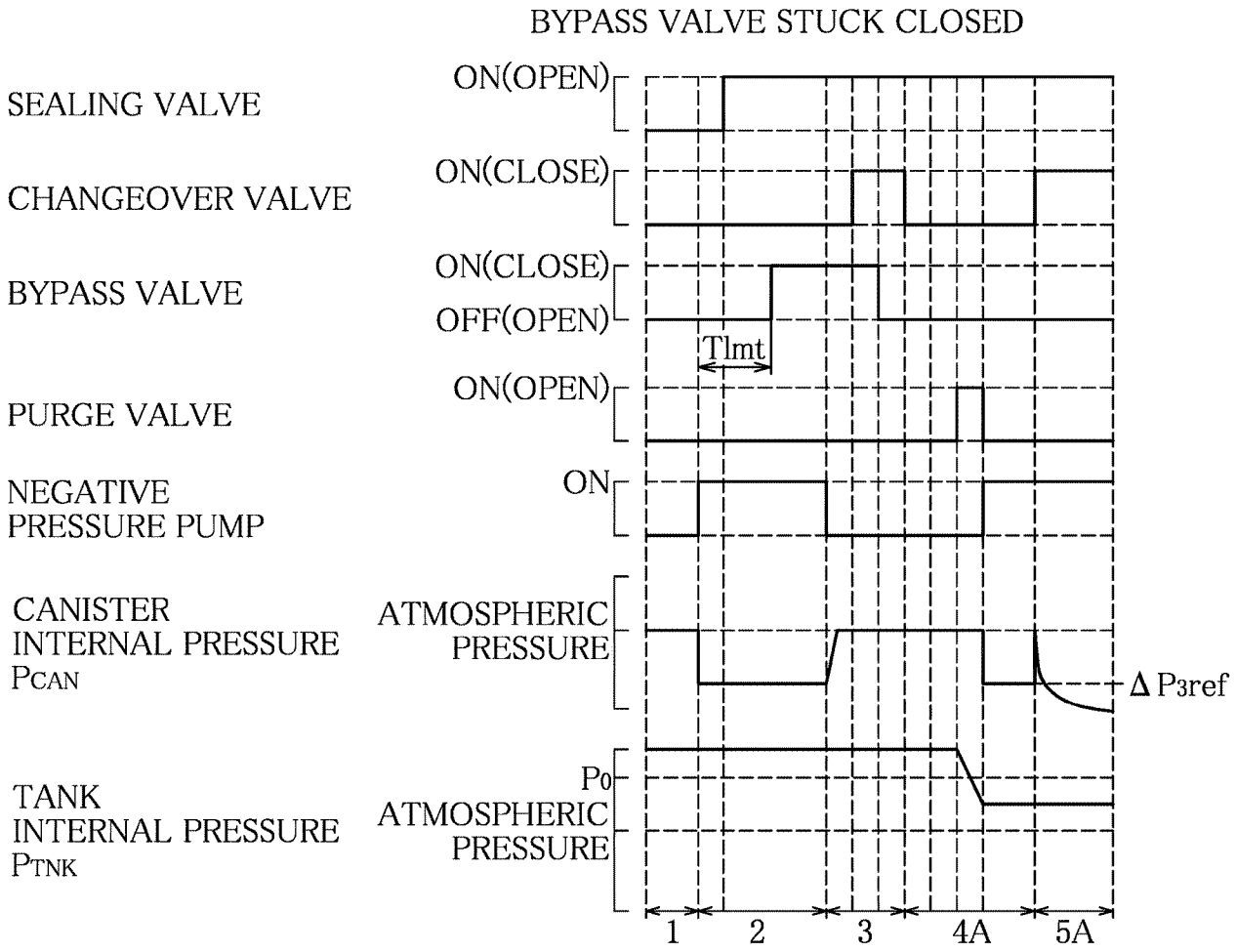
FIG. 6 is a time chart showing a control situation of leak monitoring in a case where a bypass valve is stuck closed.
Figure 7:
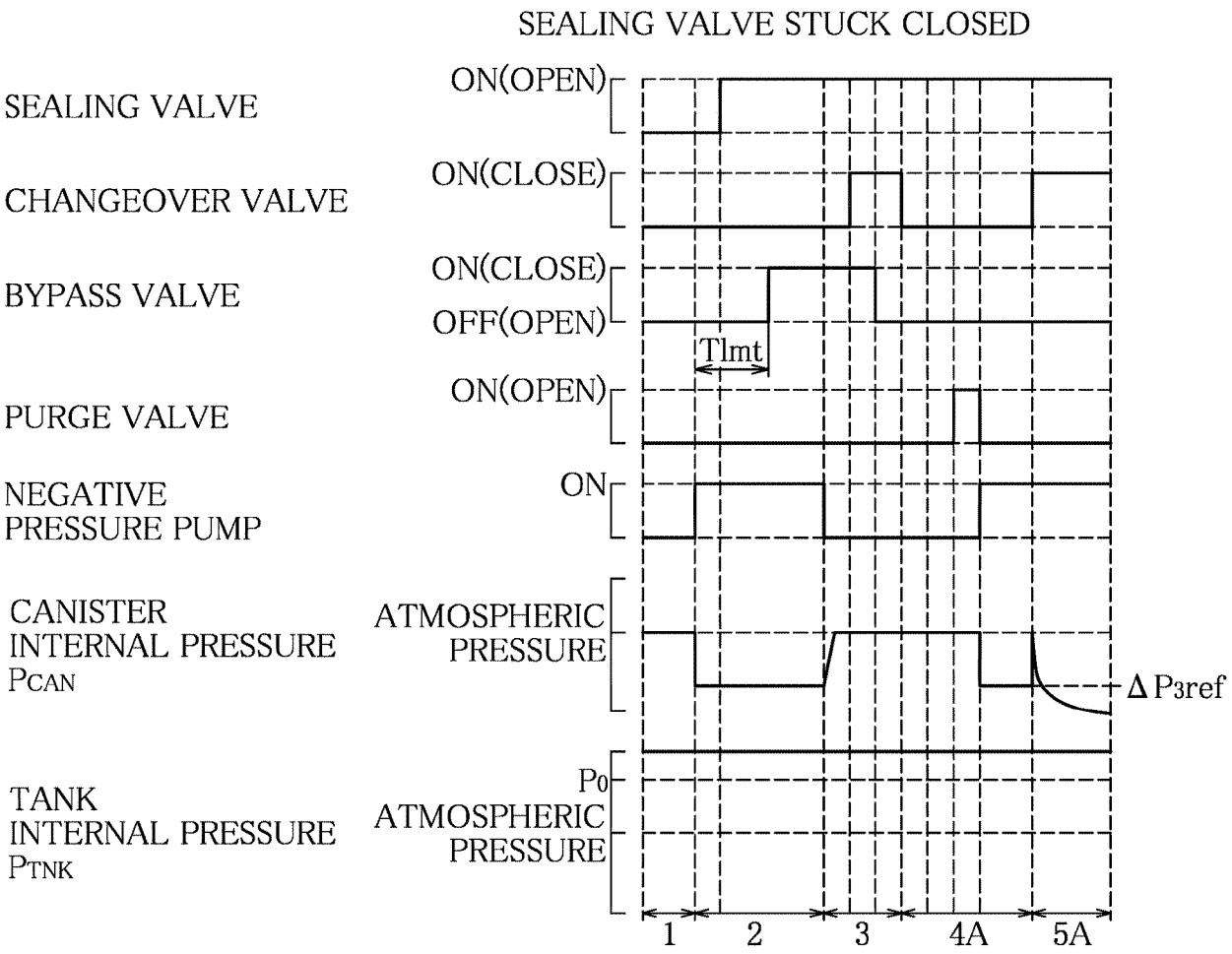
FIG. 7 is a time chart showing a control situation of leak monitoring in a case where a sealing valve is stuck closed.

FIG. 4 is a flowchart showing a control procedure of leak monitoring that is executed by the ECU 40. Further, FIGS. 5 to 7 are time charts showing states of change of drive signals of the respective valves (the sealing valve 35, the changeover valve 34*e*, the bypass valve 37 and the purge valve 36), a drive signal of the negative pressure pump 34*c*, the canister internal pressure Pcan and the tank internal pressure Ptan in leak monitoring. FIG. 5 shows a control state (subdivided into time periods 1 to 6) in a case where the entire system of the fuel evaporative gas emission control apparatus is normal. FIG. 6 shows a control state (time periods 1 to 5A) in a case where the bypass valve 37 is stuck closed. FIG. 7 shows a control state (time periods 1 to 5A)

in a case where the sealing valve 35 is stuck closed. FIG. 4 shows processing that is executed by the ECU 40 (mainly processing of reducing the internal pressure of the fuel tank 21) in a time period 2 in each of the time charts.

As shown in FIGS. 5 to 7, in an initial time period 1 when leak monitoring is started, the sealing valve 35 is closed, the changeover valve 34*e* is opened, the bypass valve 37 is opened, and the purge valve 36 is closed. The state shifts to a time period 2, and the processing in FIG. 4 is started by the ECU 40. First, in step S2, an operation of the negative pressure pump 34*c* is started for the purpose of warming up, determination of sticking of the changeover valve 34*e* and the negative pressure pump 34*c* is performed in subsequent step S4, and when it is determined that sticking is present in either one of them, the routine is ended. Accordingly, at this point of time, the leak monitoring is stopped.

Further, when it is determined that no sticking is present in both the changeover valve 34*e* and the negative pressure pump 34*c* in step S4, the sealing valve 35 is opened in step S6. In subsequent step S8, measurement of the tank internal pressure Ptan is started, and count of an operation continuation time period T of the negative pressure pump 34*c* is started. Thereafter, in step S10, it is determined whether or not the tank internal pressure Ptan is a valve opening guarantee determination value P0 or smaller, and when the determination is No (negative), the flow shifts to step S12 and it is determined whether or not the operation continuation time period T becomes a limit time period Tlmt or more. The valve opening guarantee determination value P0 is a positive value with which a valve opening delay of the bypass valve 37 does not occur, and is set in advance as the minimum tank internal pressure Ptan that can ensure precision of leak determination based on a tank internal pressure decompression amount ΔP1 and a canister internal pressure change amount ΔP2 that will be described as follows. Further, the limit time period Tlmt is set in advance as a condition for forcefully shifting to next processing when the tank internal pressure Ptan does not reduce due to sticking to closure of the bypass valve 37 and the sealing valve 35 that will be described later.

When determination of Yes (affirmative) is made in either step S10 or step S12, the flow shifts to step S14 and the bypass valve 37 is closed, and measurement of the tank internal pressure decompression amount ΔP1 is started in step S16. The tank internal pressure decompression amount ΔP1 is measured as a pressure reduction amount over time of the tank internal pressure Ptan after closing the bypass valve 37 (in other words, a pressure reduction amount over time in a site where the purge pipe 31 and the vapor pipe 32 communicate with the fuel tank 21). In subsequent step S18, it is determined whether or not the operation continuation time period T becomes a warm-up time period Twu (for example, 300 sec) that is set in advance or longer, and when determination of Yes is made, the flow shifts to step S20. In step S20, pulsation of the negative pressure pump 34*c* is detected. In subsequent step S22, presence or absence of a failure of the negative pressure pump 34*c* is determined based on the pulsation detected in step S22, and when a failure is present, the routine is ended.

Further, when it is determined that no failure is present in the negative pressure pump 34*c*, the flow shifts to step S24, and leveling processing of the pressure that is detected by the pressure sensor 34*h* is performed. Since the changeover valve 34*e* at this time is opened, air in the bypass passage 34*f* upstream of the reference orifice 34*g* is taken out to a downstream side via the reference orifice 34*g* by the negative pressure pump 34*c* to generate a negative pressure, and the negative pressure is detected by the pressure sensor 34*h* and is set as a leak determination reference value ΔP3ref as will be described later. In subsequent step S26, presence or absence of abnormality of the reference orifice 34*g* is determined based on the leak determination reference value ΔP3ref after leveling, and when abnormality is present, the routine is ended, whereas when abnormality is absent, the flow shifts to a time period 3 to continue the processing of leak monitoring in succession.

The processing of the time period 2 of the leak monitoring is executed by the ECU 40 as above. Next, the control state of the entire leak monitoring including the time period 2 will be described in sequence based on FIGS. 5 to 7.

First, when the entire system of the fuel evaporative gas emission control apparatus 1 is normal, that is, when all the valves (the sealing valve 35, the changeover valve 34*e*, the bypass valve 37 and the purge valve 36) normally open and close without being stuck, and no leak is present in the fuel tank 21, the canister 33, the purge pipe 31 and the vapor pipe 32, control advances as shown in FIG. 5.

In the time period 1 as described above, the sealing valve 35 is closed, the changeover valve 34*e* is opened, the bypass valve 37 is opened, the purge valve 36 is closed, and the canister internal pressure Pcan is kept at atmospheric pressure. Further, in the fuel tank 21, the temperature increases by high-temperature outside air during soak when the vehicle is parked, and the tank internal pressure Ptan is increased to a pressure to such an extent that a valve opening delay of the bypass valve 37 occurs, as described in [Problem to be solved by the invention].

When the state shifts from the time period 1 to the time period 2, an operation of the negative pressure pump 34*c* is started to warm up first (step S2 in FIG. 4), the air in the bypass passage 34*f* upstream of the reference orifice 34*g* is taken out to the downstream side via the reference orifice 34*g*, whereby the canister internal pressure Pcan which is detected by the pressure sensor 34*h* is reduced stepwise to be lower than the atmospheric pressure.

In parallel with the warm-up of the negative pressure pump 34*c*, a leak test for the purge pipe 31 and the vapor pipe 32 as targets (corresponding to a leak test execution unit of the present invention) is executed, and prior to the leak test, an operation of reducing the internal pressure of the fuel tank 21 (corresponding to a pressure regulation control unit of the present invention) is performed. First, the sealing valve 35 is opened (step S6 in FIG. 4), fuel evaporative gas in the fuel tank 21 flows into and adsorbed by the canister 33, and the air after adsorption is discharged to the atmosphere from the changeover valve 34*e*, whereby the tank internal pressure Ptan gradually reduces. When the tank internal pressure Ptan reduces to the valve opening guarantee determination value P0 (Yes in step S10 in FIG. 4), the bypass valve 37 is closed (step S14 in FIG. 4).

Warm-up of the negative pressure pump 34*c* is continued for the warm-up time period Twu, and the tank internal pressure decompression amount ΔP1 is measured in parallel in the warm-up time period Twu (steps S16 and 18 in FIG. 4). Since the entire system of the fuel evaporative gas emission control apparatus 1 is normal, leak does not occur to the purge pipe 31 and the vapor pipe 32, the tank internal pressure Ptan continues to be kept in a vicinity of the valve opening guarantee determination value P0, and 0 or a very small value is measured as the tank internal pressure decompression amount ΔP1.

When the state shifts to the time period 3 from the time period 2, the negative pressure pump 34*c* is stopped, the negative pressure by the reference orifice 34*g* disappears, and the canister internal pressure Pcan is returned to the atmospheric pressure. Thereafter, the changeover valve 34*e* is closed, the inside of the canister 33 is shut off from the atmosphere, and after the bypass valve 37 is opened, the change amount ΔP2 of the canister internal pressure Pcan is measured. Valve opening of the bypass valve 37 is executed under the situation where the tank internal pressure Ptan is reduced to the valve opening guarantee determination value P0, and therefore the bypass valve 37 is opened quickly without causing a delay. Since the entire system of the fuel evaporative gas emission control apparatus 1 is normal, the fuel evaporative gas in the fuel tank 21 flows into the canister 33 through the vapor pipe 32 to increase the canister internal pressure Pcan rapidly, and a large value is measured as the canister internal pressure change amount ΔP2. The tank internal pressure Ptan reduces a little due to outflow of the fuel evaporative gas from the fuel tank 21.

As a result, the tank internal pressure decompression amount ΔP1 which is measured in the time period 2 becomes less than a decompression determination value ΔP1ref, and the canister internal pressure change amount ΔP2 which is measured in the time period 3 exceeds a change amount determination value ΔP2ref. Therefore, it is determined that no leak is present in the purge pipe 31 and the vapor pipe 32. As for the fuel tank 21, absence of leak is determined at a time point at which a high pressure is kept during soak, and therefore, a detection method B that narrows down the target of the leak test to only the canister 33 (in more detail, also including the purge pipe 31 at the canister 33 side from the bypass valve 37) is selected.

When selection of the above detection method is ended, the state shifts to the time period 4B from the time period 3, and the leak test by the detection method B is started. First, the sealing valve 35 is closed, the changeover valve 34*e* is opened thereafter, and the purge valve 36 is opened. The canister 33 is opened to the atmosphere via the changeover valve 34*e* and is opened to the atmosphere via the bypass valve 37 and the purge valve 36, and the canister internal pressure Pcan which is rapidly increased by inflow of the fuel evaporative gas from the fuel tank 21 is quickly returned to the atmospheric pressure. These operations are preliminary arrangements for the leak test by the detection method B. The purge valve 36 is closed after reduction in the canister internal pressure Pcan, an operation of the negative pressure pump 34*c* is started, and the canister internal pressure Pcan reduces stepwise again due to the negative pressure which occurs by the reference orifice 34*g*.

Subsequently, when the state shifts to a time period 5B from the time period 4B, the changeover valve 34*e* is closed, and the bypass valve 37 is closed. As a result, the test condition by the detection method B in which all the valves (the sealing valve 35, the changeover valve 34*e*, the bypass valve 37 and the purge valve 36) are closed is satisfied. By closing of the changeover valve 34*e*, the sensor 34*h* communicates with the inside of the canister 33, and the canister internal pressure Pcan is temporarily returned to the atmospheric pressure, and thereafter gradually reduces as the air in the canister 33 is discharged into the atmosphere by the operation of the negative pressure pump 34*c*. The reduction amount of the canister internal pressure Pcan from the atmospheric pressure at the time of the canister 33 being decompressed like this is measured as a canister internal pressure reduction amount ΔP3.

The state shifts to a time period 6 from the time period 5B thereafter, the changeover valve 34*e* is opened, and the bypass valve 37 is opened. The canister internal pressure Pcan reduces stepwise again due to the negative pressure which is generated by the reference orifice 34*g*. The canister internal pressure Pcan at this time corresponds to a detection value in a case where the negative pressure pump 34*c* is operated in a leak occurring state by a hole corresponding to the reference orifice 34*g*, and the value is set as the leak determination reference value ΔP3ref.

Subsequently, the canister internal pressure reduction amount ΔP3 which is measured in the time period 5B and the leak determination reference value ΔP3ref which is set in the time period 6 are compared, and when the canister internal pressure reduction amount ΔP3 exceeds the leak determination reference value ΔP3ref (reduction of the canister internal pressure Pcan is rapid), it is determined that no leak is present in the canister 33, whereas when the canister internal pressure reduction amount ΔP3 is equal to or smaller than the leak determination reference value ΔP3ref (reduction of the canister internal pressure Pcan is slow), it is determined that leak is present in the canister 33. In this case, the entire system of the fuel evaporative gas emission control apparatus 1 is normal, and therefore the former determination of no leak is made.

Next, a case where the bypass valve 37 is stuck closed will be described based on FIG. 6.

A state until the sealing valve 35 is opened after the state shifts to the time period 2 from the time period 1 and the operation of the negative pressure pump 34*c* is started is the same as the state at the system normal time described above. In this case, the air in the fuel tank 21 is not discharged to the atmosphere via the canister 33, due to sticking to closure of the bypass valve 37, and therefore, the tank internal pressure Ptan is kept at an initial value (a high-pressure value in soak) without reducing to the valve opening guarantee determination value P0. Therefore, at a time point at which the operation continuation time period T becomes the limit time period Tlmt or longer, a valve opening operation of the bypass valve 37 is performed irrespective of the tank internal pressure Ptan (actually already being stuck closed). Since the tank internal pressure Ptan which should be reduced by opening of the sealing valve 35 if the system is normal does not reduce like this, it can be assumed that a certain failure (specifically, sticking to closure of the bypass valve 37 or the sealing valve 35) occurs at this point of time, and determination of a failure spot is performed by subsequent processing.

The closing operation of the bypass valve 37 is performed based on the operation continuation time period T from the start of the operation of the negative pressure pump 34*c* like this, but instead of this, the opening operation of the bypass valve 37 may be performed at a time point at which an elapsed time from the sealing valve 35 being opened (that is, a time period in which air is actually discharged from the inside of the fuel tank 21) becomes the limit time period Tlmt or longer.

Thereafter, the state shifts to the time period 3 from the time period 2, and stop of the negative pressure pump 34*c*, closing of the changeover valve 34*e*, and opening of the bypass valve 37 are sequentially performed. Since the bypass valve 37 is stuck closed, the fuel evaporative gas in the fuel tank 21 does not flow into the canister 33, the canister internal pressure Pcan does not increase, and therefore the canister internal pressure change amount ΔP2 is measured to 0. Since the canister internal pressure change amount ΔP2 is the change amount determination value ΔP2ref or smaller, it is determined that presence or absence of leak in the fuel tank 21, the purge pipe 31 and the vapor pipe 32 is unclear, and a detection method A that sets the target of the leak test as the entire system of the fuel evaporative gas emission control apparatus 1 is selected.

When the state shifts to a time period 4A from the time period 3, a leak test by the detection method A is started, the changeover valve 34*e* is opened first, and the purge valve 36 is opened. Unlike the normal time of the system described above, the canister internal pressure Pcan is originally at the atmospheric pressure due to sticking to closure of the bypass valve 37, while the sealing valve 35 is opened by selection of the detection method A, and therefore, the tank internal pressure Ptan reduces with opening of the purge valve 36 (by a reduction amount corresponding to the valve opening time period of the purge valve 36).

Since reduction of the tank internal pressure Ptan at this time means that the sealing valve 35 is normally opened, a factor that does not reduce the tank internal pressure Ptan which should be reduced due to opening of the sealing valve 35 in the above described time period 2 can be assumed to be closure of the bypass valve 37 which should be operated to be opened, and at this point of time, it is determined that the bypass valve 37 is stuck closed (a leak test execution unit). Thereafter, the purge valve 36 is closed, reduction of the tank internal pressure Ptan is stopped, an operation of the negative pressure pump 34*c*, is started, the canister internal pressure Pcan reduces stepwise again by the negative pressure which is generated by the reference orifice 34*g*, and the canister internal pressure Pcan at this time is set as the leak determination reference value ΔP3ref.

When the state shifts to a time period 5A from the time period 4A, the changeover valve 34*e* is closed. As a result, a condition by the detection method A in which the sealing valve 35 is opened, the changeover valve 34*e* is closed, the bypass valve 37 is opened, and the purge valve 36 is closed is satisfied. The canister internal pressure Pcan is temporarily returned to the atmospheric pressure and thereafter gradually reduces by the operation of the negative pressure pump 34*c*, and the reduction amount ΔP3 of the canister internal pressure Pcan at this time is measured. When the canister internal pressure reduction amount ΔP3 exceeds the leak determination reference value ΔP3ref, it is determined that no leak is present in the fuel tank 21, the canister 33, the purge pipe 31 and the vapor pipe 32, and when the canister internal pressure reduction amount ΔP3 is the leak determination reference value ΔP3ref or smaller, it is determined that leak is present in any of the fuel tank 21, the canister 33, the purge pipe 31 and the vapor pipe 32.

A behavior of the tank internal pressure Ptan in reduction of the canister internal pressure Pcan in the time period 5A like this becomes responsive to presence or absence of sticking to closure of the bypass valve 37. That is, when the bypass valve 37 is normally opened, the tank internal pressure Ptan also reduces with the canister internal pressure Pcan by communication between the fuel tank 21 and the canister 33 via the purge pipe 31 and the vapor pipe 32. In contrast to this, when the bypass valve 37 is stuck closed, the fuel tank 21 and the canister 33 are shut off from each other. Therefore, only the canister internal pressure Pcan reduces, and the tank internal pressure Ptan is kept at a fixed value without reducing as shown in the drawing.

Accordingly, when the canister internal pressure Pcan rapidly reduces (ΔP3>ΔP3ref), and the tank internal pressure Ptan also rapidly reduces with the canister internal pressure Pcan, the bypass valve 37 can be regarded as normal (no sticking to closure), whereas when the tank internal pressure Ptan does not reduce or reduction thereof is slow, although the canister internal pressure Pcan rapidly reduces, the bypass valve 37 can be regarded as being stuck closed, and the determination corresponds to the determination result of sticking to closure of the bypass valve 37 described above.

Next, a case where the sealing valve 35 is stuck closed will be described based on FIG. 7.

A state until the time point at which the state shifts to the time period 3 from the time period 2, and stop of the negative pressure pump 34*c*, closing of the changeover valve 34*e* and opening of the bypass valve 37 are sequentially performed is similar to the state at the time of sticking to closure of the bypass valve 37 described above. Since the sealing valve 35 is stuck closed in this case, the fuel evaporative gas in the fuel tank 21 does not flow into the canister 33 even if the bypass valve 37 is opened, and therefore, canister internal pressure change amount ΔP2 is measured to 0. Consequently, the canister internal pressure change amount ΔP2 is regarded as the change amount determination value ΔP2ref or smaller, and the detection method A which makes the target of the leak test the entire system of the fuel evaporative gas emission control apparatus 1 is selected.

When the state shifts to the time period 4A from the time period 3, the leak test by the detection method A is started, the changeover valve 34*e* is opened first, and the purge valve 36 is opened. An opening operation of the sealing valve 35 is performed by selection of the detection method A, but the sealing valve 35 is actually stuck closed. Therefore, unlike the time of sticking to closure of the bypass valve 37 described above, the tank internal pressure is kept at a fixed value without reducing. That is, on the ground that the tank internal pressure Ptan does not reduce, it is determined that the sealing valve 35 is stuck closed at this point of time (the leak test execution unit).

Thereafter, as in the above description, the purge valve 36 is closed, an operation of the negative pressure pump 34*c* is started, the canister internal pressure Pcan reduces stepwise again by the negative pressure which is generated by the reference orifice 34*g* and is set as the leak determination reference value ΔP3ref. When the state shifts to the time period 5A from the time period 4A, the changeover valve 34*e* is closed, the test condition by the detection method A is satisfied, and the reduction amount ΔP3 of the canister internal pressure Pcan which gradually reduces by the negative pressure pump 34*c* is measured. It is similar to the above description that leak is determined as absent in the fuel tank 21, the canister 33, the purge pipe 31 and the vapor pipe 32 when the canister internal pressure reduction amount ΔP3 exceeds the leak determination reference value ΔP3ref, and leak is determined as present in any of them, when the canister internal pressure reduction amount ΔP3 is the leak determination reference value ΔP3ref or smaller.

As above, according to the fuel evaporative gas emission control apparatus 1 of the present embodiment, when the leak test for the purge pipe 31 and the vapor pipe 32 as the targets is executed, the sealing valve 35 which is being closed is opened while the valve open state of the bypass valve 37 is kept prior to the execution of the leak test, whereby the fuel evaporative gas in the fuel tank 21 is caused to flow out to the canister 33 side to reduce the tank internal pressure Ptan to the valve opening guarantee determination value P0, and after the bypass valve 37 is closed thereafter, the leak test is started. Consequently, during the leak test, opening of the bypass valve 37 is executed under the situation where the tank internal pressure Ptan is reduced to the valve opening guarantee determination value P0, and the bypass valve 37 can be opened at a suitable timing without causing a delay.

Describing more specifically, the leak test on the purge pipe 31 and the vapor pipe 32 is carried out in sequence of measurement of the tank internal pressure decompression amount ΔP1 after closing the bypass valve 37, closing of the changeover valve 34*e*, opening of the bypass valve 37, and measurement of the canister internal pressure change amount ΔP2, and from these measurement results, presence or absence of leak is determined. When a delay occurs to opening of the bypass valve 37 at this time, the canister internal pressure Pcan does not rapidly increase although no leak is present in the purge pipe 31 and the vapor pipe 32, and therefore it is erroneously determined that leak is present based on the canister internal pressure change amount ΔP2≤the change amount determination value ΔP2ref. As a result, the detection method A which extends the target of the subsequent leak test to the entire system is erroneously selected, but a situation like this can be prevented by the processing of reducing the tank internal pressure Ptan described above.

Further, in the leak tests by the detection methods A and B, presence or absence of leak is determined based on the canister internal pressure reduction amount ΔP3 at the time of the inside of the canister 33 being decompressed by operating the negative pressure pump 34*c*, and the leak test on the purge pipe 31 and the vapor pipe 32 is executed in parallel with a warm-up of the negative pressure pump 34*c* prior to this. Since two different kinds of processing are carried out in parallel like this, a required time period of the entire leak monitoring can be significantly reduced.

Further, when the tank internal pressure Ptan does not reduce to the valve opening guarantee determination value P0 due to sticking to closure of the bypass valve 37 and the sealing valve 35, the bypass valve 37 is closed irrespective of the tank internal pressure Ptan, at the time point at which the operation continuation time period T becomes the limit time period Tlmt or longer (steps S12 and 14 in FIG. 4). Consequently, in such a case, leak monitoring can be completed by executing the processing of subsequent step S18 and the following steps, system abnormality can be grasped at this point of time, the suitable leak test of the detection method A corresponding to this is selected, and the cause of the failure (sticking to closure of the bypass valve 37 or the sealing valve 35) can be reliably determined.

In the leak test by the detection method A, it is determined whether the cause of the failure is in sticking to closure of the bypass valve 37 or sticking to closure of the sealing valve 35 based on the behavior (being reduced or not) of the tank internal pressure Ptan at the time of opening the purge valve 36. Since the cause of the failure can be determined by a simple operation like this, this factor also contributes to reduction in the required time period of the entire leak monitoring.

The forgoing is the explanation of the embodiment, but the mode of the present invention is not limited to the embodiment. For example, in the above described embodiment, the invention is embodied as the fuel evaporative gas emission control apparatus 1 which is loaded on a hybrid vehicle as a vehicle, but the kind of the vehicle is not limited to this, and the present invention may be applied to a gasoline vehicle, for example.

Further, in the above described embodiment, as the leak test which the leak test execution unit executes, the leak test for the purge pipe 31 and the vapor pipe 32 as the targets is executed, but the content thereof is not limited to this, and is arbitrarily changeable as long as the canister opening and closing valve (the bypass valve 37) is switched to open from closing during the leak test.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel evaporative gas emission control apparatus, comprising:

a communication path that provides communication between an intake passage of an internal combustion engine and a fuel tank;

a canister that is connected to the communication path and adsorbs fuel evaporative gas in the communication path;

a canister opening and closing valve that opens and closes communication between the communication path and the canister;

a purge valve that opens and closes the communication path between the intake passage and the canister;

a sealing valve that opens and closes communication between the fuel tank and the communication path;

a leak test execution unit that executes a leak test by opening the sealing valve and closing the canister opening and closing valve, and thereafter opening the canister opening and closing valve, in a state where the purge valve is closed; and a pressure regulation control unit that, prior to the leak test by the leak test execution unit, reduces an internal pressure of the fuel tank to a valve opening guarantee determination value that is set in advance by opening the sealing valve which is being closed while keeping the canister opening and closing valve in an open state, and thereafter closes the canister opening and closing valve.

2. The fuel evaporative gas emission control apparatus according to claim 1, wherein the leak test execution unit measures a change in an internal pressure of the communication path after closing of the canister opening and closing valve, measures a change in an internal pressure of the canister after opening of the canister opening and closing valve, and determines presence or absence of leak in the communication path and the fuel tank from these measurement results, as the leak test.

3. The fuel evaporative gas emission control apparatus according to claim 1, further comprising:

a negative pressure pump that decompresses an inside of the canister, wherein the leak test execution unit executes the leak test in parallel during warming up of the negative pressure pump.

4. The fuel evaporative gas emission control apparatus according to claim 2, further comprising:

a negative pressure pump that decompresses an inside of the canister, wherein the leak test execution unit executes the leak test in parallel during warming up of the negative pressure pump.

5. The fuel evaporative gas emission control apparatus according to claim 1, wherein the pressure regulation control unit closes the canister opening and closing valve at a point of time at which a limit time period that is set in advance elapses, even when the internal pressure of the fuel tank does not reduce to the valve opening guarantee determination value.

6. The fuel evaporative gas emission control apparatus according to claim 2, wherein the pressure regulation control unit closes the canister opening and closing valve at a point of time at which a limit time period that is set in advance elapses, even when the internal pressure of the fuel tank does not reduce to the valve opening guarantee determination value.

7. The fuel evaporative gas emission control apparatus according to claim 3, wherein the pressure regulation control unit closes the canister opening and closing valve at a point of time at which a limit time period that is set in advance elapses, even when the internal pressure of the fuel tank does not reduce to the valve opening guarantee determination value.

8. The fuel evaporative gas emission control apparatus according to claim 4, the pressure regulation control unit closes the canister opening and closing valve at a point of time at which a limit time period that is set in advance elapses, even when the internal pressure of the fuel tank does not reduce to the valve opening guarantee determination value.

9. The fuel evaporative gas emission control apparatus according to claim 5, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the canister opening and closing valve is stuck closed when the internal pressure of the fuel tank is reduced.

10. The fuel evaporative gas emission control apparatus according to claim 6, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the canister opening and closing valve is stuck closed when the internal pressure of the fuel tank is reduced.

11. The fuel evaporative gas emission control apparatus according to claim 7, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the canister opening and closing valve is stuck closed when the internal pressure of the fuel tank is reduced.

12. The fuel evaporative gas emission control apparatus according to claim 8, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the canister opening and closing valve is stuck closed when the internal pressure of the fuel tank is reduced.

13. The fuel evaporative gas emission control apparatus according to claim 5, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the sealing valve is stuck closed when the internal pressure of the fuel tank is not reduced.

14. The fuel evaporative gas emission control apparatus according to claim 6, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the sealing valve is stuck closed when the internal pressure of the fuel tank is not reduced.

15. The fuel evaporative gas emission control apparatus according to claim 7, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the sealing valve is stuck closed when the internal pressure of the fuel tank is not reduced.

16. The fuel evaporative gas emission control apparatus according to claim 8, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the sealing valve is stuck closed when the internal pressure of the fuel tank is not reduced.

17. The fuel evaporative gas emission control apparatus according to claim 9, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the sealing valve is stuck closed when the internal pressure of the fuel tank is not reduced.

18. The fuel evaporative gas emission control apparatus according to claim 10, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the sealing valve is stuck closed when the internal pressure of the fuel tank is not reduced.

19. The fuel evaporative gas emission control apparatus according to claim 11, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the sealing valve is stuck closed when the internal pressure of the fuel tank is not reduced.

20. The fuel evaporative gas emission control apparatus according to claim 12, wherein the leak test execution unit opens the sealing valve and the canister opening and closing valve respectively when the canister opening and closing valve is closed based on the lapse of the limit time period by the pressure regulation control unit, thereafter measures a change in the internal pressure of the fuel tank at a time of the purge valve being opened, and determines that the sealing valve is stuck closed when the internal pressure of the fuel tank is not reduced.

* * * * *